United States Patent [19]

Wisner

[11] Patent Number: 4,907,951

[45] Date of Patent: Mar. 13, 1990

[54] FOREIGN PARTICLE TRAP FOR A COMPRESSOR

[75] Inventor: Ronald R. Wisner, Adrian, Mich.

[73] Assignee: Tecumseh Products Company, Tecumseh, Mich.

[21] Appl. No.: 245,791

[22] Filed: Sep. 16, 1988

[51] Int. Cl.[4] ..... F04B 39/02; F04B 39/16

[52] U.S. Cl. ..... 417/368; 417/902; 184/6.24

[58] Field of Search ..... 184/6.18, 6.16, 6.23, 184/6.24; 417/368, 423.7, 423.9, 90 Z

[56] References Cited

U.S. PATENT DOCUMENTS

| | | | |
|---|---|---|---|
| 1,895,027 | 1/1933 | DeMees . | |
| 1,986,539 | 1/1935 | Schmidt . | |
| 3,049,285 | 8/1962 | Doeg . | |
| 3,560,116 | 2/1971 | Valbjorn et al. . | |
| 3,674,382 | 7/1972 | Kubota et al. . | |
| 3,692,435 | 9/1972 | Iida et al. . | |
| 3,830,341 | 8/1974 | Davies et al. . | |
| 3,926,281 | 12/1975 | Hannibal . | |
| 3,947,530 | 3/1976 | Marder . | |
| 4,153,392 | 5/1979 | Elson . | |
| 4,406,594 | 9/1983 | Smaby et al. . | |
| 4,850,819 | 7/1989 | Bush et al. | 417/368 |

FOREIGN PATENT DOCUMENTS

| | | | |
|---|---|---|---|
| 55-084881 | 6/1980 | Japan | 417/368 |
| 55-125374 | 9/1980 | Japan | 417/368 |
| 62-026385 | 2/1987 | Japan | 417/368 |

*Primary Examiner*—Leonard E. Smith
*Assistant Examiner*—Eugene L. Szczecina
*Attorney, Agent, or Firm*—Albert L. Jeffers; Lawarence A. Steward

[57] ABSTRACT

A pick-up tube for removing foreign particles from the lubricant supplied to hermetic motor-compressors of the type including an outer housing, a lubricant sump in the bottom of the housing, and a rotatable shaft vertically disposed in said housing is provided. The pick-up tube includes an annular groove disposed circumferentially around the pick-up tube, wherein foreign particles found in the lubricant are deposited in the groove as the particles move up the pick-up tube as a result of the centrifugal force created by the rotating of the shaft.

11 Claims, 1 Drawing Sheet

FOREIGN PARTICLE TRAP FOR A COMPRESSOR

BACKGROUND OF THE INVENTION

This invention relates to a centrifugal lubricant pick-up tube of the type suitable for use in hermetic motor-compressors, and in particular to such a tube which includes means for preventing foreign particles entrained in the lubricant from being circulated through the lubricant passageways of the compressor.

In hermetic motor-compressors, which are sealed units, the bearing regions are often lubricated by means of a lubricant pick-up tube, which is rotated about its longitudinal axis and has one end immersed in the compressor lubricant sump. The tube is mounted on the drive shaft of the compressor and exerts a centrifugal pumping action on the lubricant which flows through the lower open end of the tube. The tube propels the lubricant upwardly by means of centrifugal force to passageways in the shaft, which ultimately lead to the bearing regions of the compressor. The lubricant may contain foreign particles and contaminants left in the compressor during the manufacturing and installation process, and also particles deposited by the gradual wearing of the working parts during operation of the compressor. If these foreign particles are allowed to pass through the lubricant passageways and into the bearings, the bearings will wear rapidly and result in a reduced operating life of the compressor.

Prior lubrication systems used with hermetic compressors of this type generally provide a trap to separate the foreign particles from the lubricant, and to prevent these particles from circulating through the compressor with the lubricant. U.S. Pat. No. 3,049,285 contains a die cast oil lifting device which includes a lubricant passageway in communication with the circumferential pocket. Foreign particles are deposited in this pocket by centrifugal force. U.S. Pat. No. 3,692,435 discloses an oil lifting device comprising a revolving shaft which extends vertically into the lubricant and has a lubricant passage bored therethrough. Either a machined step portion or an insert is used to block the foreign particles from proceeding upwardly in the lubricant passageways.

U.S. Pat. No. 3,674,382 discloses a revolving shaft with a lubricant passageway, and having a portion of the shaft cut away. The cut-away portion is in communication with the lubricant passageway, and is enclosed with a ring-sleeve to define a receptacle for the foreign particles. These prior art devices are expensive to manufacture due to the particular die casting or machining required. Additionally, their use is limited to these compressor systems compatible with the particular die cast dimensions employed. U.S. Pat. No. 3,560,116 discloses a hermetically sealed motor-compressor unit in which the motor and the compressor are each cooled by separate oil flows. This patent includes a pick-up tube having an annular protuberance at its upper end that contains openings 48 on the upper portion of the protuberance. The compressor is cooled and lubricated in the normal manner by way of lubricant being propelled upwardly by centrifugal force through the pick-up tube and into the compressor bearing regions. An independent flow of lubricant passes through openings 48 to cool the stator. Openings 48 would likely allow foreign particles to accompany the lubricant which passes through opening 48 to the stator, thus causing the bearings to wear rapidly and also to reduce the operating life of the unit.

It is therefore desired to provide a pick-up tube for removing foreign particles from the lubricant supplied to a hermetic compressor that overcomes the disadvantages found in the prior art. It is further desired to provide such a pick-up tube that is efficient in operation and does not require costly machining or die casting of the drive shaft or oil lifting mechanism.

SUMMARY OF THE INVENTION

The present invention overcomes the disadvantages of prior art centrifugal oil pick-up tube lubricating devices by providing an inexpensive oil pick-up tube which contains an annular recess whereby foreign particles may be separated from the lubricant prior to entry of the lubricant into the lubricant passageways in the drive shaft, for eventual distribution throughout the compressor.

Specifically, the problems inherent in prior art devices are solved by providing a pick-up tube that may be manufactured from relatively inexpensive materials, and contains a recess that may be inexpensively formed in the tube. The necessity to use expensive die casting or other machinery to form passageways and traps to remove the foreign particles is eliminated.

In one embodiment of the invention, an annular recess may be formed about the entire circumference of the pick-up tube. Foreign particles contained in the lubricant are flung into the recess by centrifugal force as the lubricant climbs the tube as a result of the centrifugal action created by the rotating of the shaft. The heavier metal contaminants are flung outwardly into the recess and remain there as long as the shaft is in rotation. When the rotation is stopped, the particles merely drop by gravity back into the lubricant sump. Upon re-activation of the rotating shaft the process repeats itself, and the contaminants are once again flung into the recess to effect separation from the lubricant.

In a separate embodiment of the present invention, the annular recess includes a trap into which the foreign particles are permanently deposited. In this embodiment, the recess includes a barrier which is passed by the particles as they climb up the tube by the centrifugal action. As the particles pass this barrier they are flung outwardly into the recess area of the pick-up tube. When the drive shaft is stopped the particles settle into the trap, where they are prevented from returning to the sump.

An advantage of the present invention is that it provides the very simple but effective method for preventing foreign particles and contaminants from intruding into the moving parts of the motor-compressor during lubrication of those moving parts.

Another advantage of the present invention is that it inhibits premature wear and destruction of the moving parts of the motor-compressor by preventing foreign particles from intruding into these parts.

Still another advantage of the present invention is that it provides a simple pick-up tube that is adapted to be easily attached to the drive shaft of the motor-compressor and eliminates the need for expensive die casting or machining of the shaft.

A further advantage of the present invention is that, in one embodiment thereof, it provides a trap to permanently receive the foreign particles and prevent them from returning to the lubricant sump.

The invention, in one form thereof, provides a motor-compressor including a housing, a lubricant sump in the bottom of said housing, and a rotatable drive shaft vertically disposed in said housing. Means are provided for removing foreign particles from lubricant supplied to the hermetic compressor, the means comprising a lubricant pick-up tube having one end attached to the shaft for rotation therewith, and its opposite end extending vertically into the lubricant sump. The pick-up tube has an axial bore extending upwardly therethrough and further has annularly disposed recess means extending radially outwardly from the inner surface of the pick-up tube. Foreign particles are trapped and retained in the recess means as they move up the pick-up tube by the centrifugal force created by the rotation of the drive shaft. When the rotation of the shaft is stopped, the foreign particles drop back into the lubricant sump.

The invention, in another form thereof, comprises a motor-compressor including an outer housing, a lubricant sump in the bottom of the housing, a rotatable shaft vertically disposed in the housing, a lubricant pick-up tube attached to the shaft, and a trap for permanently removing foreign particles from the lubricant supplied to the hermetic motor compressor. The trap further comprises an annular recess extending radially outwardly from the inner surface of the pick-up tube, and extending circumferentially around the tube. Foreign particles are trapped in the annular recess as they move up the pick-up tube by centrifugal force. The trap includes a barrier that prevents the foreign particles from returning to the lubricant sump when the shaft stops rotating.

DETAILED DESCRIPTION OF THE PREFERRED EMBODIMENT

Figure 1:
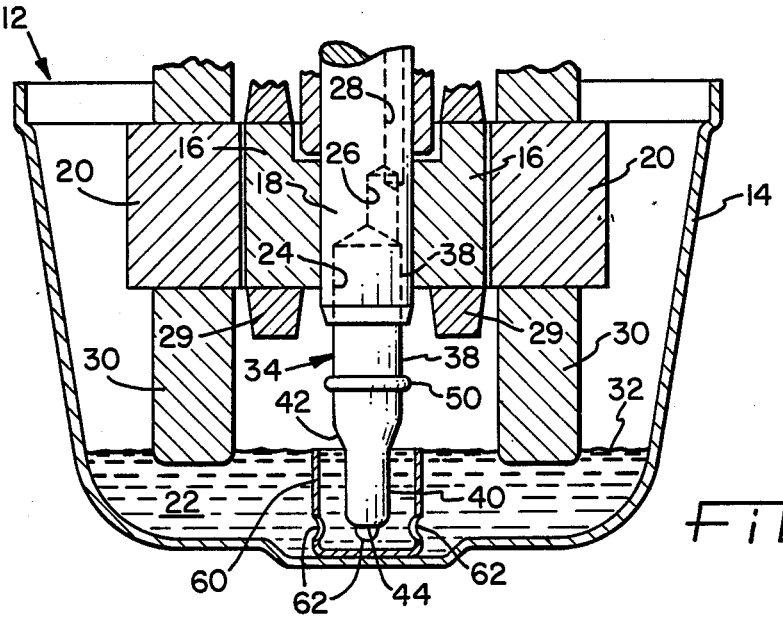
FIG. 1 is a longitudinal sectional view of the lower portion of a hermetic motor-compressor unit incorporating one embodiment of the present invention.

Referring to the drawings, and particularly to FIG. 1, the lower portion of a hermetic motor-compressor unit 12 is illustrated comprising a compressor outer housing 14 enclosing rotor 16 which is secured to drive shaft 18 to rotate therewith, stator 20 which is secured within housing 14, and lubricant sump 22 disposed in the lower portion of outer housing 14. Drive shaft 18 is conventionally mounted within the motor-compressor unit 12 and has axially disposed therein a plurality of passageways 24, 26, 28 for delivering lubricant to the upper components of motor-compressor 12. The portion of the lubricant that is delivered upwardly through passages 24, 26, 28 generally returns to lubricant sump 22 by gravity.

Rotor 16 includes rotor end rings 29. Stator 20 includes end turns 30 extending downwardly in outer housing 14 so that the lower end portions of end turns 30 may be disposed below the level of oil 32 in lubricant sump 22.

Lubricant pick-up tube 34 according to the present invention comprises a tubular body which is preferably made from aluminum killed deep draw quality cold rolled steel, although other materials are also suitable. Upper portion 38 of pick-up tube 34 is press fit within passageway 24 of drive shaft 18. Lower portion 40 of pick-up tube 34 is disposed below lubricant level 32. Upper portion 38 of pick-up tube 34 is generally cylindrical and is of larger diameter, and lower portion 40 of pick-up tube 34 is generally cylindrical and is of smaller diameter. Transition region 42 tapers upwardly in the outer direction and connects upper and lower portions 38 and 40. The upper end of portion 38 is open and the lower end of portion 40 is open and is provided with an inlet port 44 which is smaller in diameter than lower portion 40. The remainder of pick-up tube 34 is substantially imperforate. Pick-up tube 34 has axial bore 46 extending therethrough and in communication with passgeway 24 of shaft 18. An oil cup 60 is secured to bottom portion of outer housing 14 in coaxial, spaced-apart relationship with pick-up tube 34 to reduce the effects of cavitation. Cup 60 is provided with a plurality of holes 62 so that lubricant in lubricant sump 22 may pass into cup 60.

Figure 2:
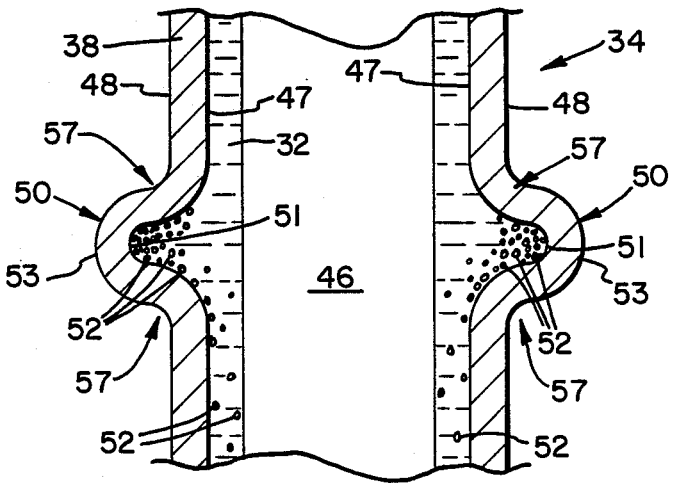
FIG. 2 is an enlarged fragmentary sectional view of the pick-up tube of FIG. 1.

According to the present invention, an annular recess 50 is disposed about the circumference of upper portion 38 of pick-up tube 34. In a preferred embodiment shown in FIGS. 1 and 2, the annular recess 50 extends about the entire circumference of pick-up tube 34 and forms a generally continuous groove. Annular recess 50 is produced by deforming upper portion 38 of pick-up tube 34, as best shown in FIG. 2. A depression 51 is formed in pick-up tube inner surface 47 and a corresponding rib 53 is formed on outer surface 48. Depression 51 and rib 53 are in radial alignment. Annular recess 50, according to the present invention, may have dimensions in accordance with the following schedule which is submitted by way of example only:

Radius of Curvature of outer surface area 57: 0.025 inch

Radius of Curvature of depression 51: 0.005 inch

Width of annular recess 50 along tube 34: approximately 0.125 inch

Depth of annular recess 50, measured from outer surface 48: approximately 0.25 inch During operation of the motor-compressor unit, shaft 18 is rotated which causes the rotation of pick-up tube 34 within enclosure 60. Lubricant within lubricant sump 22 is then drawn upwardly by centrifugal force through inlet port 44 and axial bore 46 to lubricant passageways 24, 26, 28. Foreign particles 52 and other contaminants present in lubricant sump 22 are also drawn upwardly by centrifugal action through axial bore 46 along with the lubricant. As foreign particles 52 reach annular recess 50, foreign particles 52, being heavier than the lubricant, are flung into annular recess 50 as best shown in FIG. 2. The centrifugal force created by the rotation of shaft 18 causes particles 52 to remain in annular recess 50 until the rotation of shaft 18 is stopped. At this time particles 52 merely drop back into lubricant sump 22 by gravity. The centrifugal force which propels the particles into recess 52 prevents them from proceeding further upward through axial bore 46 into passageways 24, 26, 28 where they could cause damage and unnecessary wear to the motor-compressor.

Figure 3:
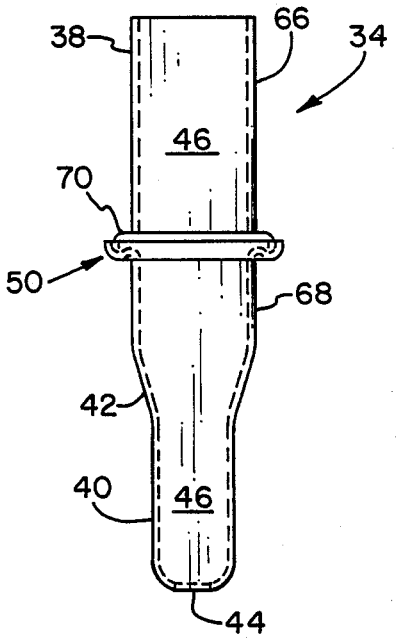
FIG. 3 is an enlarged view of a pick-up tube of the compressor of FIG. 1, in accordance with an alternate embodiment.
Figure 4:
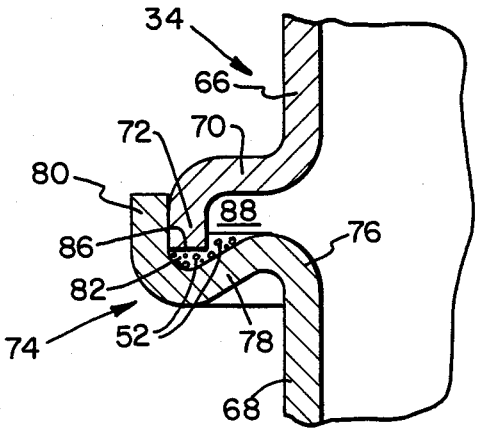
FIG. 4 is an enlarged, fragmentary sectional view of the pick-up tube of FIG. 3.

FIGS. 3 and 4 show an alternate embodiment of the invention. According to this embodiment, pick-up tube 34 is of two-piece construction, comprising an upper member 66 and a lower member 68. Upper member 66 has a flange portion 70 and an end portion 72. Lower member 68 has an S-shaped outwardly disposed extension 74 including a barrier portion 76, a downwardly inclined intermediate portion 78, and a generally vertical end portion 80 extending upwardly from portion 78, as best shown in FIG. 4. A trap 82 is formed as a result of the bend at the juncture of downwardly inclined intermediate portion 78 and end portion 80. Lower edge 86 of end portion 72 is disposed in the area of trap 82. In operation, the rotation of shaft 18 and pick-up tube 34 causes lubricant to be drawn upwardly by centrifugal force, as in the previous embodiment. Foreign particles 52 and the contaminants present in lubricant sump 22 are also drawn upwardly by the centrifugal action. As foreign particles 52 pass barrier 76 they are flung into recessed area 88, created as a result of the joinder of tube members 66 and 68. Particles 52 drop by gravity into trap 82 which serves to retain the foreign particles. When the rotation of shaft 18 terminates, the foreign particles remain in trap 82, rather than returning to the lubricant sump as in the previous embodiment.

It will be appreciated that the foregoing is presented by way of illustration only, and not by way of any limitation, and that various other alternatives and modifications may be made to the illustrated embodiment without departing from the spirit and scope of the invention.

What is claimed is:

1. In a hermetic compressor which includes an outer housing, a lubricant sump in the bottom of said housing, a rotatable shaft vertically disposed in said housing above the lubricant level in the sump and means for rotating said shaft, a lubricant pick-up tube comprising one end attached to said shaft for rotation therewith and an opposite end extending vertically into said lubricant sump, said tube being open at both ends and having an axial bore defined by an inner wall of said tube extending upwardly through said tube from said opposite end, said pick-up tube being of two-piece construction comprising upper and lower members each having annular outward extensions, said extensions being joined to form a continuous annular groove extending radially outwardly from the inner surface of said pick-up tube for trapping foreign particles as they move up said pick-up tube for centrifugal force, the wall of said tube being substantially imperforate in the area of said recess mean, said annular outward extension of said lower member having a greater radial outward dimension than said annular outward extension of said upper member.

2. The compressor of claim 1 wherein said pick-up tube has a generally cylindrical body.

3. The compressor according to claim 1 wherein said generally continuous annular groove further includes a trap portion and a barrier positioned axially higher than the trap portion of said annular groove whereby foreign particles removed from said lubricant by centrifugal force are deposited by gravity into said trap portion of said annular groove.

4. In a hermetic compressor which includes an outer housing, a lubricant sump in the bottom of said housing, a rotatable shaft vertically disposed in said housing and means for rotating said shaft, a lubricant pick-up tube comprising:

an upper member and a lower member, said pick-up tube being open at both ends and having an axial bore extending therethrough;

said upper member having one end attached to said shaft for rotation therewith, and having an annular outwardly disposed flange portion formed at its opposite end;

said lower member having one end extending vertically into said lubricant sump and having an annular outwardly disposed extension formed at its opposite end, said outwardly disposed extension being joined to said flange portion to define an annularly disposed recess means in said pick-up tube for trapping foreign particles as they move up said tube;

said outwardly disposed extension comprising a barrier portion formed from said lower member, a downwardly disposed intermediate portion extending radially outward from said barrier portion, and an end portion extending generally upward from said intermediate portion, said intermediate portion and said end portion forming a trap at their juncture.

5. The compressor according to claim 4 wherein said pick-up tube has a generally cylindrical body.

6. The compressor according to claim 4 wherein said annularly disposed recess means comprises a generally continuous annular groove.

7. In a hermetic compressor which includes an outer housing, a lubricant sump in the bottom of said housing, a rotatable shaft vertically disposed in said housing and means for rotating said shaft, a lubricant pick-up tube comprising:

an upper member and a lower member, said pick-up tube being open at both ends and having an axial bore extending therethrough;

said upper member having one end attached to said shaft for rotation therewith, and having an annular outwardly disposed flange portion formed at its opposite end;

said lower member having one end extending vertically into said lubricant sump and having an annular outwardly disposed extension formed at its opposite end, said outwardly disposed extension being joined to said flange portion to define an annularly disposed recess means in said pick-up tube for trapping foreign particles as they move up said tube;

said annular outward extension of said lower member having a greater radial outward dimension than said annular outward extension of said flange portion of said upper member.

8. A pick-up tube for use in removing foreign particles from lubricant passage in a hermetic device which includes a lubricant sump and a vertically disposed rotary shaft having a central bore therein and disposed above the lubricant level in the sump, said tube comprising:

a body having an upper end and a lower end and having openings at each of said ends, said body further having a passage extending therethrough from said lower end opening to said upper end opening, said passage situated substantially in axial alignment with said shaft, said body further having annularly disposed recess means extending radially outwardly;

said pick-up tube being of two-piece construction comprising upper and lower portions each having annular outward extensions wherein said annular extension of said lower portion is joined to said annular extension of said upper portion, and further wherein said lower annular extension has a greater radial outer dimension than said upper annular extension.

9. A pick-up tube according to claim 8 wherein said body is of generally cylindrical configuration.

10. A pick-up tube as described in claim 8 wherein said annularly disposed recess means comprises a generally continuous annular groove.

11. A pick-up tube according to claim 8 wherein said generally continuous annular groove further includes a barrier positioned axially higher than a portion of said annular groove whereby foreign particles removed from said lubricant by centrifugal force are deposited by gravity into said lower positioned portion of said annular groove.

* * * * *